US005934111A

United States Patent [19]

Hernandez

[11] Patent Number: 5,934,111

[45] Date of Patent: Aug. 10, 1999

[54] SECURITY LOCKING DEVICE FOR CLOSURES

[76] Inventor: Rigoberto Hernandez, 5371 W.4 Ct., Hialeah, Fla. 33012

[21] Appl. No.: 09/045,207

[22] Filed: Mar. 20, 1998

[51] Int. Cl.[6] ..... E05C 19/08

[52] U.S. Cl. ..... 70/2; 70/56; 70/212; 292/205; 292/281; 292/283; 292/DIG. 32; 292/DIG. 36

[58] Field of Search ..... 70/54–56, 417, 70/DIG. 58, 202, 203, 211, 212, 2–13; 292/205, 281–287, DIG. 32, DIG. 36

[56] References Cited

U.S. PATENT DOCUMENTS

| | | | |
|---|---|---|---|
| 1,004,758 | 10/1911 | Ebbert | 70/DIG. 58 X |
| 1,403,252 | 1/1922 | Knapp | 70/13 |
| 1,403,253 | 1/1922 | Knapp | 70/13 |
| 1,726,162 | 8/1929 | Pique | 70/11 |
| 1,988,185 | 1/1935 | Borden | 70/13 |
| 2,226,346 | 12/1940 | Mussman | 70/DIG. 58 X |
| 2,520,742 | 8/1950 | Soref et al. | 292/281 |
| 2,549,938 | 4/1951 | Seaman, Jr. | 292/285 |
| 2,825,218 | 3/1958 | O'Brien | 292/283 |
| 3,869,162 | 3/1975 | Schuller | 292/283 |
| 3,924,887 | 12/1975 | Markovitch | 292/283 |
| 4,074,549 | 2/1978 | Yee | 70/7 |
| 4,876,865 | 10/1989 | Trinidad et al. | 70/203 |

FOREIGN PATENT DOCUMENTS

| | | | |
|---|---|---|---|
| 161043 | 6/1933 | Switzerland | 292/285 |

*Primary Examiner*—Lloyd A. Gall
*Attorney, Agent, or Firm*—J. Sanchelima

[57] ABSTRACT

A security locking and reinforcement device to be used with doors, such as residential door and roll-up doors of the type that includes a plurality of horizontal slots defined by adjacent joined horizontal members, wherein the door is mounted within a substantially rectangular opening in a wall, and comprising a supporting plate assembly having a hanging plate removably mounted to the wall adjacent to the door; an elongated plate assembly hingedly mounted to the supporting plate assembly and having inner and outer surfaces. A security locking and reinforcement device also includes an assembly for locking the elongated plate assembly to the supporting plate assembly when the former is brought against the latter, and further including an assembly, such as a threaded rod, to engage the commonly found slots in commercial roll-up doors so that the door is kept locked in place which simultaneously enhancing its structural integrity of the roll-up door.

3 Claims, 2 Drawing Sheets

SECURITY LOCKING DEVICE FOR CLOSURES

BACKGROUND OF THE INVENTION

1. Field of the Invention

The present invention relates to a security locking device, and more particularly, to the type that prevents the unauthorized opening and/or removal of doors.

2. Description of the Related Art

Many security locking devices exist that secure different types of doors used in residential and commercial closures. However, none of them discloses the features of the present invention.

The present invention has a compact structure with an elongated plate that is installed on the walls adjacent to the closure member being secured. The present invention overcomes common problems, such as those encountered by commercial roll-up doors, because it prevents the door from being removed from its guiding security sliding rails when a wrongdoer applies a major force against it, such as crashing a vehicle against the roll-up door bending the guiding members. The present invention provides a structural element that enhances the structural integrity of the roll-up door. With conventional doors with knobs, the latter is protected against tampering.

SUMMARY OF THE INVENTION

It is one of the main objects of the present invention to provide a security locking device that prevents closure members, such as residential and commercial doors, from being removed and/or opened.

It is another object of this invention to provide a security locking device that has a strong and compact structure enhancing the structural integrity of the closure member.

It is still another object of the present invention to provide a security locking device that is simple to install.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
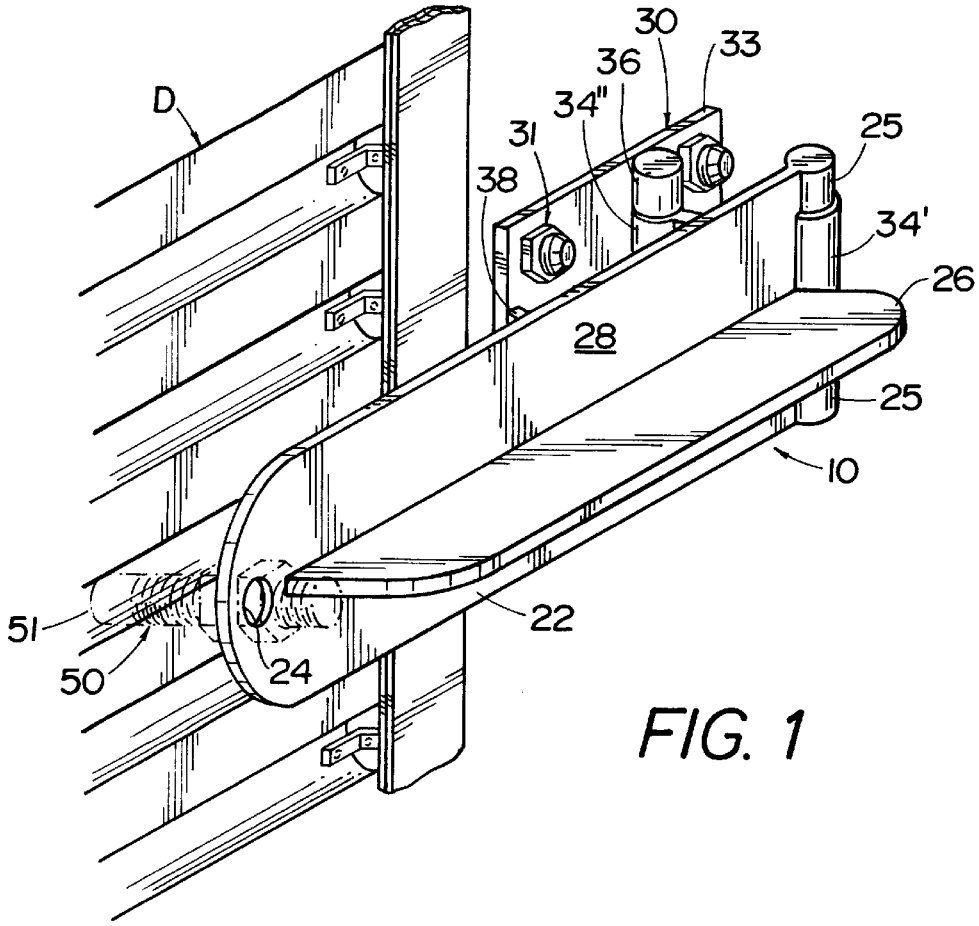
FIG. 1 is an isometric view from the top of the present invention in locked position and mounted to a wall adjacent to the door being secured.

Referring now to the drawings, where the present invention is generally referred to with numeral 10, it can be observed that it basically includes security plate assembly 20 hingedly mounted to supporting plate assembly 30 and locked in place by locking assembly 40. Device 10 enhances the structural integrity of the closure member being protected and immobilizes it. Additionally, device 10 protects locking assembly 40 from tampering.

In FIG. 1, threaded rod 50 protrudes through security plate assembly 20 at sufficient distance to engage the slots formed between adjoining horizontal members of roll-up door D. This is one of the applications for the present invention. FIG. 1 illustrates security locking device 10 in closed or locked position. Supporting plate assembly 30 is mounted to a wall adjacent to the opening where the closure member being protected is mounted by fastening members 31 and security plate assembly 20 is brought toward door D.

Figure 2:
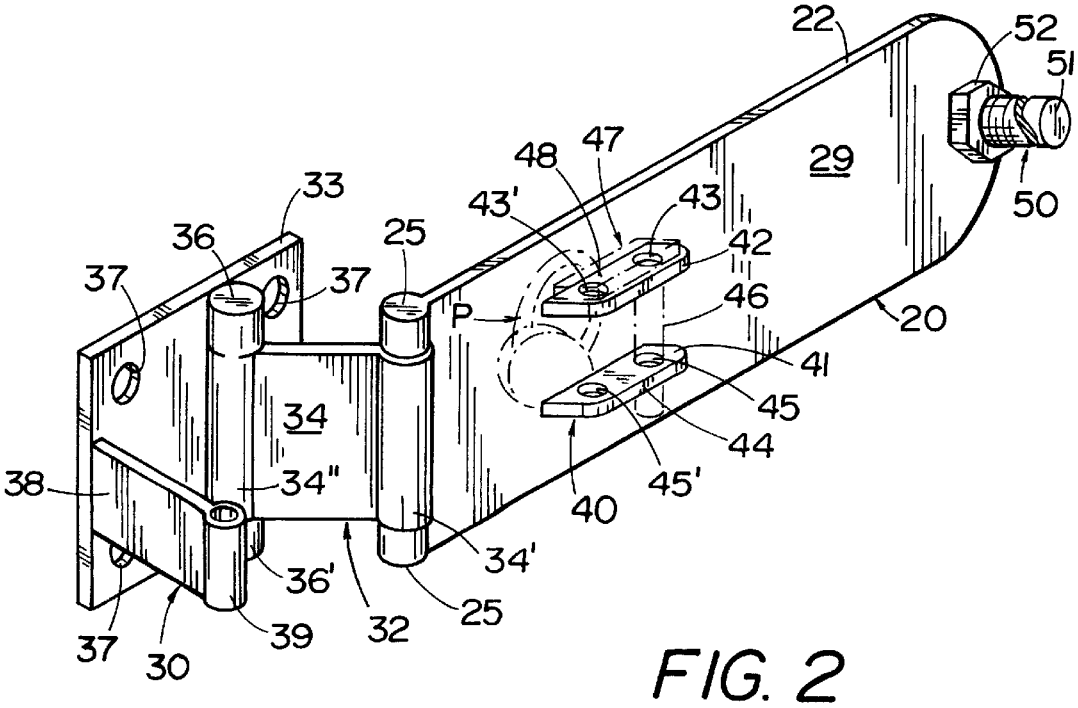
FIG. 2 is another isometric view of the present invention in open or unlocked position, showing a padlock and the locking pin in phantom.

Security plate assembly 20, in the preferred embodiment, includes elongated plate member 22 hingedly mounted, at one end, to supporting plate assembly 30 by connecting or spacer member 32, as best seen in FIG. 2. Security plate assembly 20 has, at the other end, threaded through opening 24 to cooperatively receive threaded rod 50 through. As shown in FIG. 1, elongated plate member 22 has elongated rib 26 rigidly mounted to the center portion of its outer surface 28. Elongated rib 26 is designed to strengthen plate member 22.

As best seen in FIG. 2, supporting plate assembly 30 has spacer member 32 hingedly mounted to hanging plate 33 and elongated plate member 22. Spacer member 32 basically includes planar portion 34 having tubular end members 34' and 34' at its ends. Tubular member 34' hingedly receives pin 25 that in turn is rigidly mounted to elongated plate member 22. Tubular end member 34" is in co-planar alignment with tubular hinge members 36 and 36' so that spacer member 32 pivots with respect to hanging plate 33. Hanging plate 33 includes openings 37 that permit the use of screws or the like, in order to mount the present invention to the walls adjacent to door D to be protected. Supporting plate assembly 30 also has plate 38 rigidly and perpendicularly mounted adjacent to one edge of plate 33. Plate 38 has, at the opposite end, tubular member 39. Tubular member 39 is intended to cooperatively receive removable locking pin member 41 of locking assembly 40, in locked position.

Figure 3:
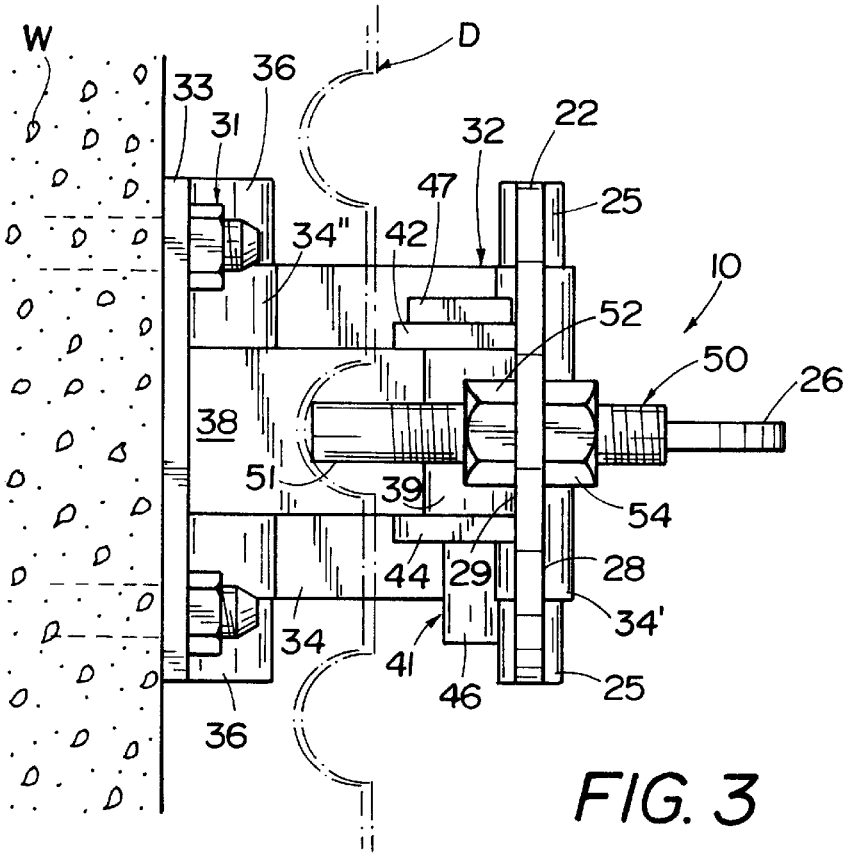
FIG. 3 is a side view of this invention in locked position, showing one end of the security threaded rod positioned towards a slot of a commercial roll-up door. The roll-up door is shown in phantom.
Figure 4:
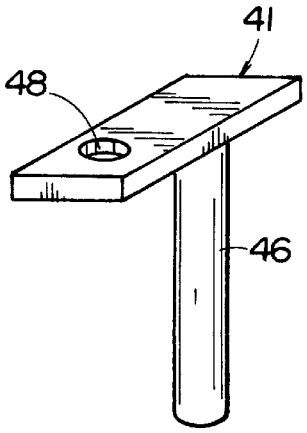
FIG. 4 is an isometric view from the top of a locking pin member.

Locking assembly 40, in the preferred embodiment, is mounted to inner surface 29 of elongated plate member 22. Locking assembly 40, as best seen in FIG. 2, comprises elongated plates 42 and 44, and removable locking pin member 41. Elongated plate 42 has openings 43 and 43' and is perpendicularly mounted to surface 29. Plate 44 is positioned at spaced apart and parallel relationship with respect to elongated plate 42. Plate 44 has openings 45 and 45' that are coaxially aligned with openings 43 and 43'. Locking pin member 41, in the preferred embodiment, has an "L" shape and includes shank 46 and plate 47, perpendicularly mounted with respect to each other as best illustrated in FIG. 4. Shank 46 is rigidly mounted to one end of plate 47. Plate 47, in turn, has opening 48 located at its distal end and cooperatively aligned with opening 43' of plate 42. When a user wants to secure door D, security plate assembly 20 is brought toward door D, as illustrated in FIGS. 1 and 3. In this manner, plates 42 and 44 are positioned above and below tubular member 39 allowing pin member 41 to be inserted through opening 43, tubular member 39 and opening 45. Then, plate 47 is placed above plate 42 aligning opening 43' with opening 48. The shackle of padlock P passes through openings 48 and 43'. If device 10 is installed on the opposite side of the closure member, it is then merely flipped, since plates 42 and 44 are symmetrical.

Threaded rod 50 is inserted through threaded opening 24 and end 51 is brought against one of the slots of roll-up door D. Rod 50 is secured in place with nuts 52 and 54. Nuts 52 and 54 sandwich the distal end of plate member 22, as best shown in FIG. 3. Threaded rod 50 is designed and installed to coincide with one of the horizontal slots typically found in roll-up doors. In this manner, device 10 prevents the movement of door D while at the same time provides the necessary structural element to reinforce door D against inward force.

Figure 5:
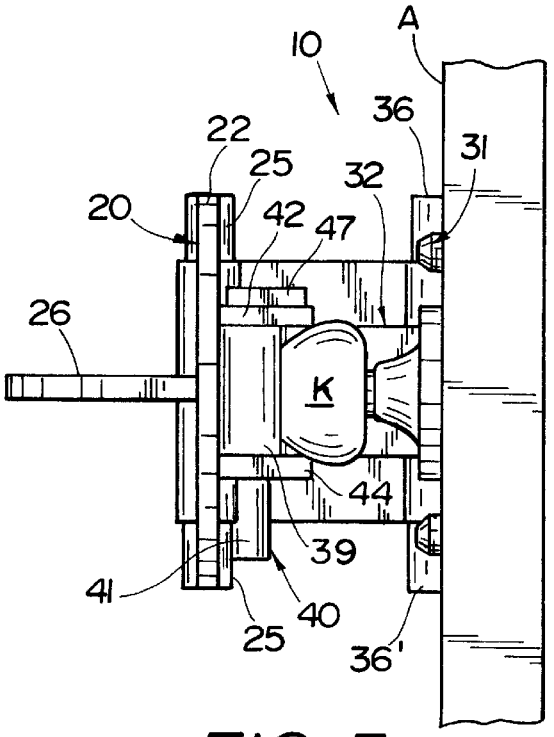
FIG. 5 is an elevational side view of this invention protecting the knob and locking assembly of a residential door A.

As shown in FIG. 5, device 10 can be used in conventional residential doors A to provide a stop function to prevent the spinning of the door and simultaneously prevents access to a knob K, lock assembly, and/or a pad-lock. Threaded rod 50 is not needed with doors that swing about a vertical axis, such as conventional doors.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A security locking and reinforcement device to be used with doors, said doors being mounted within an opening in a wall, said device comprising:

A) a supporting plate assembly having a hanging plate adapted to be mounted to the wall adjacent to said opening, including a first spacer plate having first and second ends, said first end being hingedly mounted to said hanging plate, said supporting plate assembly further including a second spacer plate with third and fourth ends, said third end being rigidly and perpendicularly mounted to a predetermined position on said hanging plate thereby defining a space between said first and second spacer plates;

B) an elongated plate assembly having inner and outer surfaces and fifth and sixth ends, said fifth end being hingedly mounted to said second end wherein said outer surface includes an elongated rib member extending therealong and wherein said inner surface includes two parallel and spaced apart plates perpendicularly mounted thereon and each inner surface plate including cooperating and coaxially disposed openings, including a tubular member mounted to said fourth end at a spaced apart relationship with respect to said hanging plate so that when said elongated plate assembly is brought against said supporting plate assembly said coaxially disposed openings are placed in alignment with said tubular member, and further including a pin that is removably inserted through said coaxially disposed openings and said tubular member; and C) means for locking said elongated plate assembly to said second spacer plate of said supporting plate assembly and further including a locking member that is received within said space when said device is in locked position.

2. The device set forth in claim 1 wherein said elongated plate assembly includes a threaded opening adjacent to said sixth end and further including a rod with a cooperating thread so that said rod is mounted through said threaded opening to engage with said door.

3. The device set forth in claim 1 wherein a door includes a knob that is housed within said space in the locked position.

* * * * *